US010780332B1

(12) United States Patent
Lilleston et al.

(10) Patent No.: US 10,780,332 B1
(45) Date of Patent: Sep. 22, 2020

(54) LASER GOLF SWING TRAINER ASSEMBLY

(71) Applicants: Clay Lilleston, Novato, CA (US); George Gonzalez, Novato, CA (US)

(72) Inventors: Clay Lilleston, Novato, CA (US); George Gonzalez, Novato, CA (US)

( * ) Notice: Subject to any disclaimer, the term of this patent is extended or adjusted under 35 U.S.C. 154(b) by 0 days.

(21) Appl. No.: 16/705,816

(22) Filed: Dec. 6, 2019

(51) Int. Cl.
*A63B 69/36* (2006.01)

(52) U.S. Cl.
CPC ..... *A63B 69/3614* (2013.01); *A63B 2207/02* (2013.01); *A63B 2210/50* (2013.01); *A63B 2225/093* (2013.01); *A63B 2225/12* (2013.01)

(58) Field of Classification Search
USPC ..... 473/219–227, 257, 266–268, 278
See application file for complete search history.

(56) References Cited

U.S. PATENT DOCUMENTS

D198,459 S * 6/1964 Blythe ..... D21/791
3,776,555 A * 12/1973 Hagaman ..... A63B 69/3614 473/221
3,801,108 A * 4/1974 Murray ..... A63B 69/3614 473/225
4,383,687 A * 5/1983 Wolff ..... A63B 24/0003 359/872
5,087,047 A * 2/1992 McConnell ..... A63B 69/36 250/215
5,926,780 A * 7/1999 Fox ..... A63B 24/0021 473/140
D470,424 S 2/2003 Hand
6,821,211 B2 11/2004 Otten
7,181,853 B2 2/2007 Heger
7,815,517 B1 * 10/2010 Sardo ..... A63B 69/3623 473/267
8,052,543 B2 11/2011 Choi
8,684,858 B2 * 4/2014 Gribovsky ..... A63B 69/3676 473/257
9,114,302 B2 * 8/2015 Mendelsohn ..... A63B 71/0622
9,671,094 B2 6/2017 Ball
9,914,019 B1 * 3/2018 Hackett ..... A63B 69/3641
2003/0148815 A1 * 8/2003 Swistock ..... A63B 69/3676 473/257
2007/0243944 A1 * 10/2007 Paukune ..... A63B 24/0003 473/267
2011/0159980 A1 * 6/2011 Pelz ..... A63B 69/3614 473/220
2014/0024470 A1 1/2014 Pao

FOREIGN PATENT DOCUMENTS

WO WO03024552 3/2003

* cited by examiner

*Primary Examiner* — Nini F Legesse

(57) ABSTRACT

A laser golf swing trainer assembly for practicing proper golf swing form includes a pair of light units and a mirror. Each light unit comprises a tripod having a center pole and a set of foldable legs coupled to the center pole. The center pole is telescopable. A mount is coupled to a top end of the center pole of the tripod. A laser is coupled to the mount. The laser has a housing coupled to the mount and a spinning mirror coupled to a topside of the housing. The spinning mirror projects the laser 360° and forms a complete plane. The mirror comprises a frame and a mirror glass coupled to the frame. The mirror glass is coupled to a front side of the frame. A kickstand is coupled to a backside of the frame. The kickstand supports the frame in conjunction with a bottom edge of the frame.

7 Claims, 4 Drawing Sheets

LASER GOLF SWING TRAINER ASSEMBLY

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to golf swing trainer devices and more particularly pertains to a new golf swing trainer device for practicing proper golf swing form.

(2) Description of Related Art Including Information Disclosed Under 37 CFR 1.97 and 1.98

The prior art relates to golf swing trainer devices. Many existing golf swing trainer devices employ optical sensors and lasers in a complex system to analyze a user's swing. Such devices often require technologically advanced equipment, may require a computer, and thus are cost prohibitive to most golfers. The current invention seeks to utilize lasers as an efficient means to create an optical plane in three-dimensional space without requiring additional technology.

(h) BRIEF SUMMARY OF THE INVENTION

An embodiment of the disclosure meets the needs presented above by generally comprising a pair of light units and a mirror. Each light unit comprises a tripod having a center pole and a set of foldable legs coupled to the center pole. The center pole is telescopable. A mount is coupled to a top end of the center pole of the tripod. A laser is coupled to the mount. The laser has a housing coupled to the mount and a spinning mirror coupled to a topside of the housing. The spinning mirror projects the laser 360° and forms a complete plane. The mirror comprises a frame and a mirror glass coupled to the frame. The mirror glass is coupled to a front side of the frame. A kickstand is coupled to a backside of the frame. The kickstand supports the frame in conjunction with a bottom edge of the frame.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
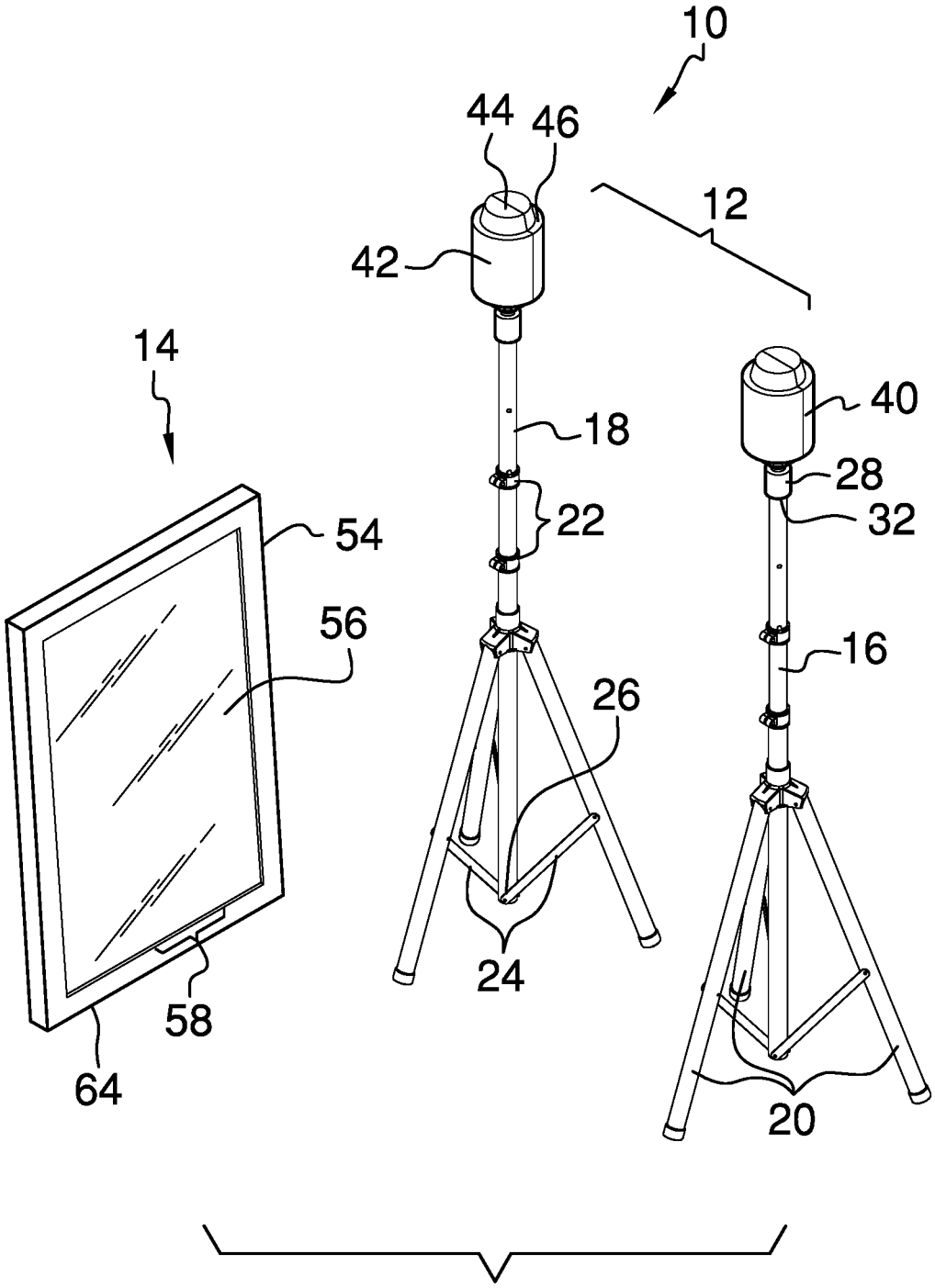
FIG. 1 is an isometric view of a laser golf swing trainer assembly according to an embodiment of the disclosure.
Figure 2:
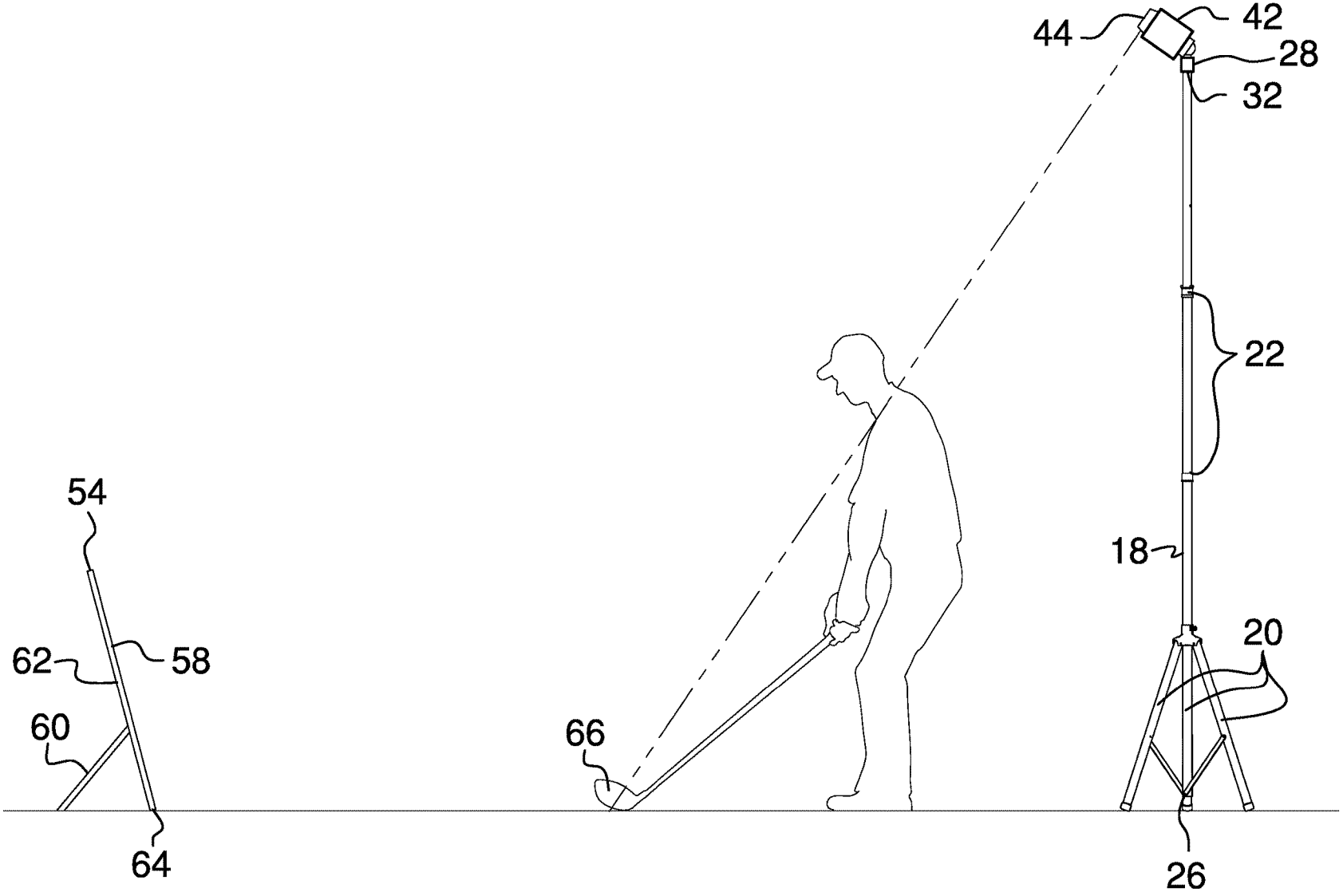
FIG. 2 is an in-use view of an embodiment of the disclosure.
Figure 3:
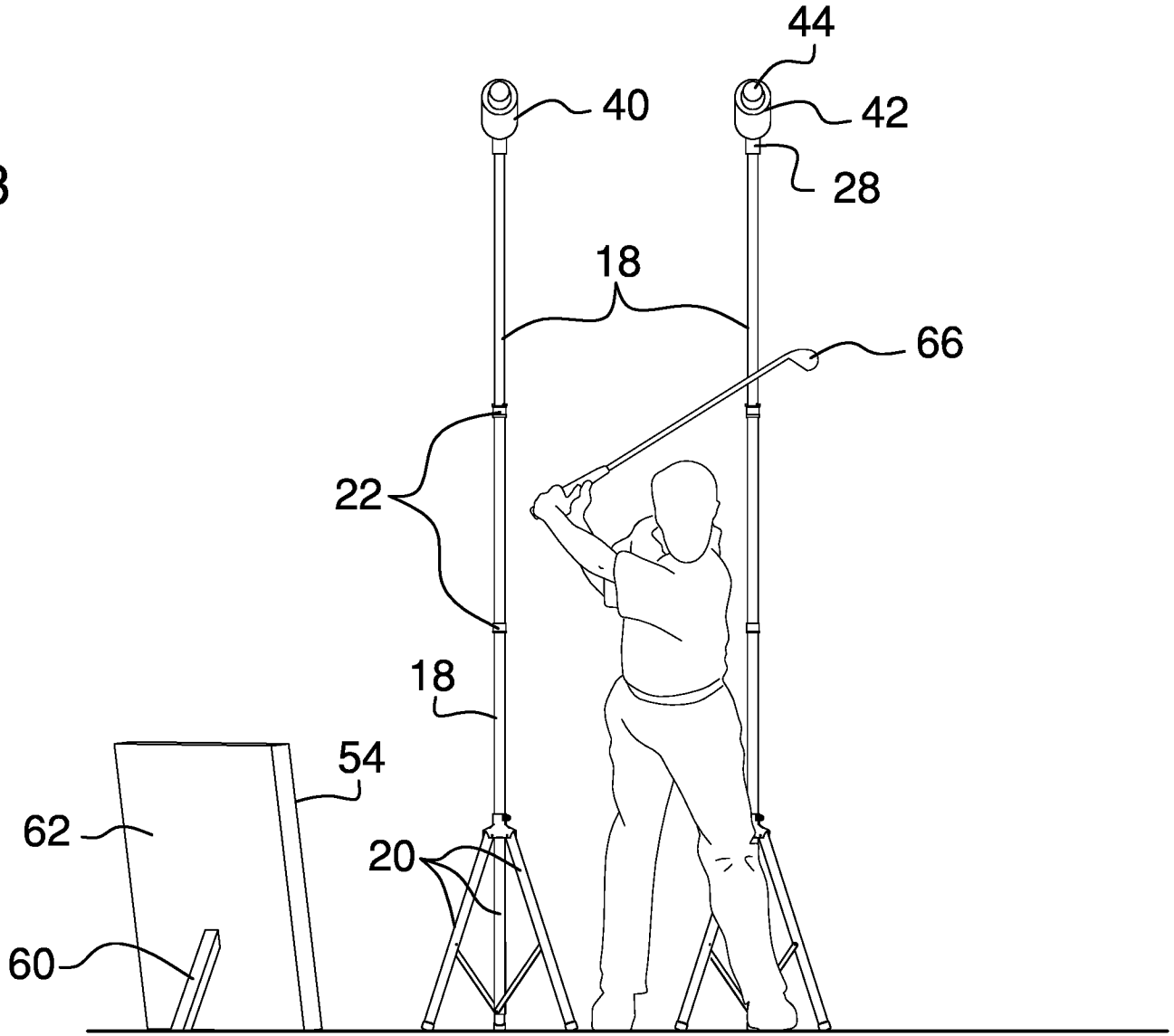
FIG. 3 is an in-use view of an embodiment of the disclosure.
Figure 4:
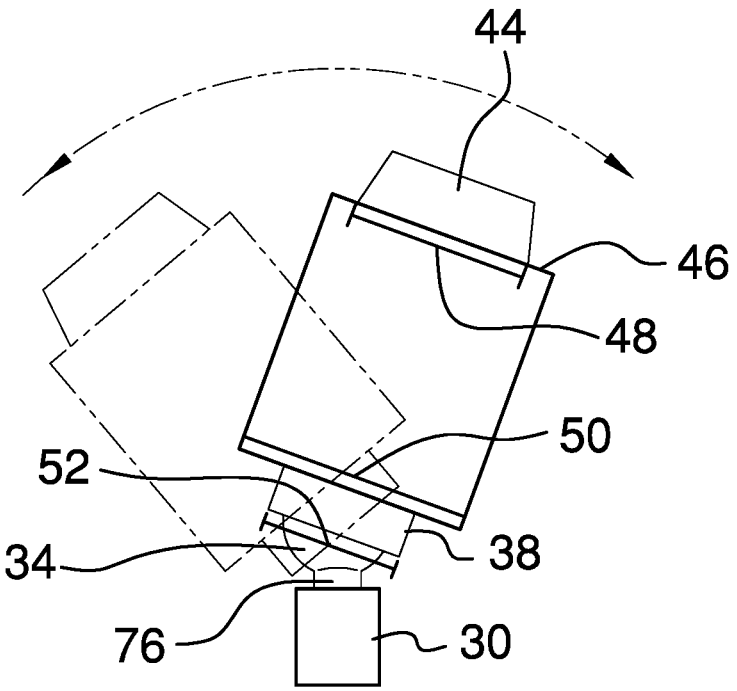
FIG. 4 is a detail view of an embodiment of the disclosure.

With reference now to the drawings, and in particular to FIGS. 1 through 4 thereof, a new golf swing trainer device embodying the principles and concepts of an embodiment of the disclosure and generally designated by the reference numeral 10 will be described.

As best illustrated in FIGS. 1 through 4, the laser golf swing trainer assembly 10 generally comprises a pair of light units 12 and a mirror 14. Each light unit 12 comprises a tripod 16 having a center pole 18 and a set of foldable legs 20 coupled to the center pole 18. The center pole 18 is telescopable and may have a pair of adjustment clamps 22 to selectively tighten or loosen the center pole 18 and adjust its height. The center pole 18 may have a set of support arms 24 extending from a bottom end 26 of the center pole to the set of foldable legs 20.

A mount 28 is coupled to the tripod 16. The mount 28 may have a collar 30 coupled to a top end 32 of the center pole. A ball 34 has an extension rod 36 coupled to the collar 30. A cup 38 is pivotably and rotationally coupled to the ball 34. A laser 40 is coupled to the mount 28. The laser 40 has a cylindrical housing 42 coupled to the cup 38 of the mount and a spinning mirror 44 coupled to a topside 46 of the housing. The spinning mirror 44 may be a truncated cone. The spinning mirror 44 projects the laser 360° and forms a complete plane. A base diameter 48 of the laser is less than a housing diameter 50 of the housing. A cup diameter 52 of the cup is also less than the housing diameter 50.

The mirror 14 comprises a frame 54 and a mirror glass 56 coupled to the frame 54. The mirror glass 56 is coupled to a front side 58 of the frame. A kickstand 60 is coupled to a backside 62 of the frame. The kickstand 60 supports the frame 54 in conjunction with a bottom edge 64 of the frame to allow the user to watch his swing in the mirror glass 56.

In use, the mirror 14 is positioned in front of the user's practice area six feet from the golf ball and the pair of light units 12 is placed four feet behind the user. One light unit 12 is positioned such that the laser 40 projects over the user's shoulder along a target line intersection the golf ball and parallel to the user's stance. The other light unit 12 is positioned at the same height and rotated to create an angle of 20° with the target line and intersecting the target line at the golf ball. The user may then watch his swing in the mirror 14 to see if the laser 40 projects onto a club head 66, knowing he has broken the desired swing path.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A laser golf swing trainer assembly comprising:

a pair of light units, each light unit comprising:

a tripod, the tripod having a center pole and a set of foldable legs coupled to the center pole, the center pole being telescopable;

a mount coupled to the tripod, the mount being coupled to a top end of the center pole; and a laser coupled to the mount, the laser having a housing coupled to the mount and a spinning mirror coupled to a topside of the housing, the spinning mirror projecting the laser 360° and forming a complete plane; and a mirror, the mirror comprising:

a frame;

a mirror glass coupled to the frame, the mirror glass being coupled to a front side of the frame; and a kickstand coupled to the frame, the kickstand being coupled to a backside of the frame, the kickstand supporting the frame in conjunction with a bottom edge of the frame.

2. The laser golf swing trainer assembly of claim 1 further comprising the housing of the laser being cylindrical.

3. The laser golf swing trainer assembly of claim 1 further comprising the spinning mirror of the laser being a truncated cone.

4. The laser golf swing trainer assembly of claim 3 further comprising a base diameter of the laser being less than a housing diameter of the housing.

5. The laser golf swing trainer assembly of claim 1 further comprising the mount having a collar coupled to the top end of the center pole, a ball coupled to the collar, and a cup pivotably and rotationally coupled to the ball.

6. The laser golf swing trainer assembly of claim 5 further comprising the ball having an extension rod coupled to the collar.

7. A laser golf swing trainer assembly comprising:

a pair of light units, each light unit comprising:

a tripod, the tripod having a center pole and a set of foldable legs coupled to the center pole, the center pole being telescopable;

a mount coupled to the tripod, the mount having a collar coupled to a top end of the center pole, a ball having an extension rod coupled to the collar, and a cup pivotably and rotationally coupled to the ball; and a laser coupled to the mount, the laser having a cylindrical housing coupled to the cup of the mount and a spinning mirror coupled to a topside of the housing, the spinning mirror being a truncated cone, the spinning mirror projecting the laser 360° and forming a complete plane; and a mirror, the mirror comprising:

a frame;

a mirror glass coupled to the frame, the mirror glass being coupled to a front side of the frame; and a kickstand coupled to the frame, the kickstand being coupled to a backside of the frame, the kickstand supporting the frame in conjunction with a bottom edge of the frame.

* * * * *